US007467472B2

(12) United States Patent
Jacq

(10) Patent No.: US 7,467,472 B2
(45) Date of Patent: Dec. 23, 2008

(54) METHOD OF CONTROLLING A FEELER TO READ THE BEZEL OF AN EYEGLASS FRAME

(75) Inventor: Francis Jacq, Charenton (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 0 days.

(21) Appl. No.: 12/064,498

(22) PCT Filed: Jul. 26, 2006

(86) PCT No.: PCT/FR2006/001819

§ 371 (c)(1),
(2), (4) Date: Feb. 22, 2008

(87) PCT Pub. No.: WO2007/026060

PCT Pub. Date: Mar. 8, 2007

(65) Prior Publication Data

US 2008/0216330 A1 Sep. 11, 2008

(30) Foreign Application Priority Data

Aug. 31, 2005 (FR) ..... 05 08897

(51) Int. Cl.
*A61B 3/11* (2006.01)

(52) U.S. Cl. ..... 33/200; 33/507; 33/28

(58) Field of Classification Search ..... 33/200, 33/1 N, 507, 511–512, 28, 559
See application file for complete search history.

(56) References Cited

U.S. PATENT DOCUMENTS

| | | | | |
|---|---|---|---|---|
| 6,325,700 | B1 | 12/2001 | Mizuno et al. | |
| 6,473,977 | B1 | 11/2002 | Kujawa | |
| 7,140,119 | B2 * | 11/2006 | Badami et al. | 33/507 |
| 2002/0104226 | A1 * | 8/2002 | Eto et al. | 33/507 |
| 2002/0166247 | A1 | 11/2002 | Andrews et al. | |
| 2008/0022539 | A1 * | 1/2008 | Haddadi | 33/200 |

FOREIGN PATENT DOCUMENTS

| | | |
|---|---|---|
| EP | 1 037 008 A2 | 9/2000 |
| EP | 1 060 834 A1 | 12/2000 |

OTHER PUBLICATIONS

Dec. 28, 2006 International Search Report in corresponding PCT/FR2006/001819.

* cited by examiner

*Primary Examiner*—Yaritza Guadalupe-McCall
(74) *Attorney, Agent, or Firm*—Young & Thompson

(57) ABSTRACT

A method of reading the outline of the bezel of a rim of an eyeglass frame, includes the steps of putting a feeler into contact against the bezel and of feeling the bezel by sliding or running the feeler along the bezel, the feeler being actuated by actuator elements along at least a first axis normal to the general plane of the rims of the frame. According to the invention, the overall force delivered by the actuator elements varies continuously or in step during reading as a function of the position of the feeler along the first axis.

7 Claims, 6 Drawing Sheets

Fig.6B
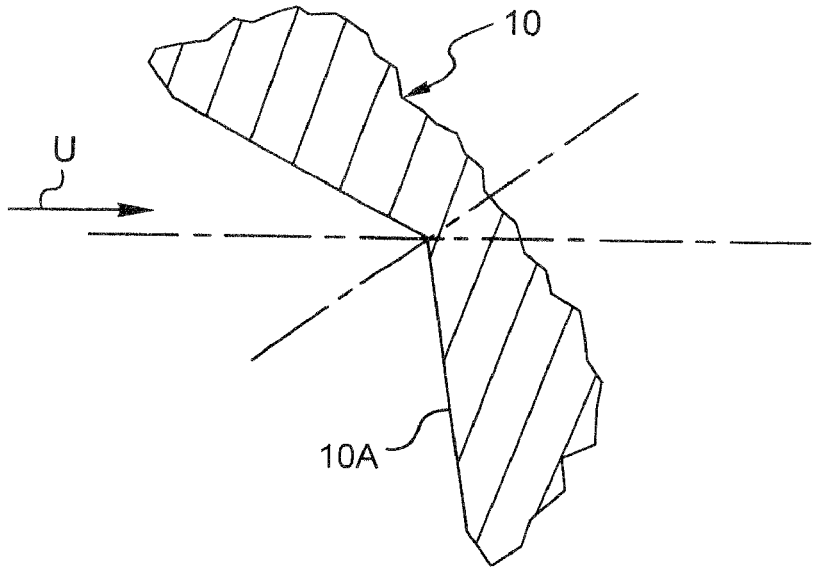
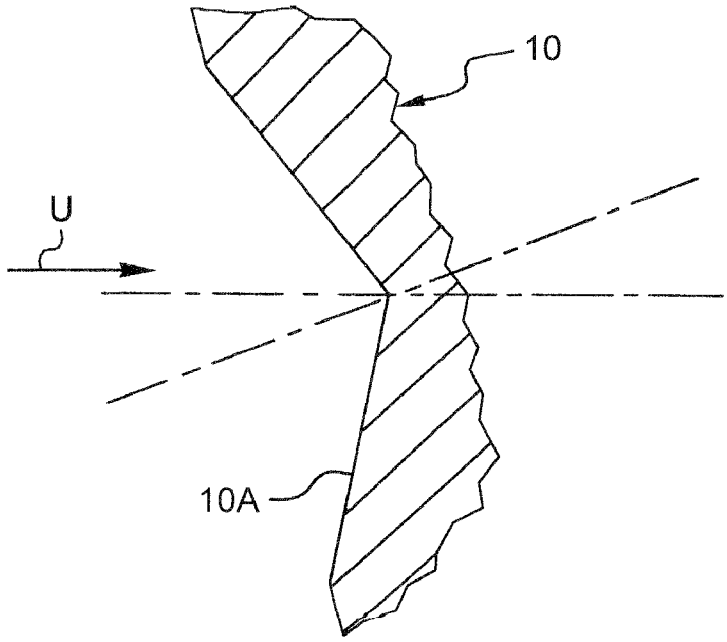
Fig.6A

METHOD OF CONTROLLING A FEELER TO READ THE BEZEL OF AN EYEGLASS FRAME

TECHNICAL FIELD TO WHICH THE INVENTION RELATES

The present invention relates in general to the field of eyeglasses and more precisely to feeling the bezel of a frame for rimmed eyeglasses.

The invention relates more particularly to a method of reading the outline of the bezel of a rim of an eyeglass frame, the method comprising the steps of putting a feeler into contact against the bezel and of feeling the bezel by sliding or running said feeler along the bezel, the feeler being actuated by actuator means along at least a first axis normal to the general plane of the rims of the frame.

The method finds a particularly advantageous application when used with eyeglasses that have frames that are strongly cambered, i.e. strongly curved.

TECHNOLOGICAL BACKGROUND

The technical portion of the work performed by an optician consists in mounting a pair of ophthalmic lenses in a frame selected by a wearer. Such mounting is made up of five main operations:

- reading the outlines of the bezels of the rims of the frame selected by the wearer, i.e. the outlines of the grooves going around the inside of each of the rims of the frame;
- centering each lens, which consists in determining the position that each lens is to occupy in the frame so as to be appropriately centered relative to the wearer's eye;
- feeling each lens, which consists in determining the coordinates of points characterizing the shape for the outlines of the lenses; then
- shaping each lens which consists in machining or cutting its outlines to the desired shape, given the defined centering parameters; and finally
- beveling which consists in forming a bevel that is to hold the lens in the bezel included in the frame.

In the context of the present invention, it is the first operation of reading the outlines of the bezels of the rims of the frame that is of interest. Specifically, the optician needs to feel the inner outline of the rims of the selected eyeglass frame in order to determine accurately the coordinates of points characterizing the outline of the bottom of the bezel. Knowledge of this outline enables the optician to deduce the shape that is to be presented by each of the lenses once they have been shaped and beveled so as to enable them to be mounted in the frame.

The particular purpose of this operation is to follow very exactly the bottom of the bezel included in each of the rims that is to be read so as to be capable of storing an accurate digital image of the shape of the bezel.

For frames that are strongly "curved" and "skewed", i.e. strongly cambered and twisted, merely pressing the feeler against the bezel orthogonally to the axis of rotation of the feeler does not enable the feeler to follow the bottom of the V-shaped bezel accurately. In particular, when the "skew" or twisting of the frame is very considerable, and one of the side faces of the bezel is steeply inclined, then there is a risk of the feeler escaping from the bezel by sliding along that side surface.

By way of example, document U.S. Pat. No. 6,325,700 presents a device for following a bezel, which device is designed to mitigate this problem of escaping from the bezel.

The device comprises an outline reader appliance in which a frame is placed, the appliance controlling the position of the feeler as a function of the curvature of the path followed by the feeler.

The drawback of such a device is that in certain portions of the rim of the frame, and in particular in its temple portions, the curvature of the path followed by the feeler along a first axis (normal to the general plane of the rims of the frame) is not large, unlike the skew of the frame. As a result, in certain portions of the rim, the control over the position of the feeler does not respond effectively to the skew of the frame.

OBJECT OF THE INVENTION

In order to remedy the above-mentioned drawback in the state of the art, the present invention proposes a simple method of reading the outline of a bezel that enables the bottom of the bezel to be read accurately.

More particularly, the invention provides a method of reading the outline of a bezel as defined in the introduction, in which during reading, the overall force delivered by the actuator means is caused to vary, either continuously or in steps, as a function of the position of the feeler along the first axis.

Thus, by means of the invention, starting from a sample of typical frames, it is possible to define positions of the feeler along the first axis that are characteristic of eyeglass frames and from which it is necessary to vary the forces exerted by the feeler against the bezel of the frame being felt. These values are thus defined and remain the same regardless of the frame that is placed in the outline reader appliance, and regardless of whether or not the frame is very cambered. Furthermore, the feeler is controlled in force and not in position. The appliance can thus be set quickly and easily.

According to a first characteristic of the invention, the actuator means present an axis of rotation about which the feeler turns to enable it to slide along the complete outline of the rim, said axis of rotation of the feeler coinciding with the first axis.

Advantageously, the overall force delivered by the actuator means comprises an axial component parallel to the first axis and a transverse component orthogonal to the first axis, one and/or the other of said components varying as a function of the position of the feeler along the first axis.

Thus, the actuator means are suitable for exerting a force that enables the feeler to be constrained to remain at the bottom of the bezel. The transverse component of the overall force is a conventional component that makes it possible, so long as the V-shaped bezel is not "skewed", for the feeler to slide over either of the side surfaces of the V-shape of the bezel towards the bottom of the bezel and to remain there. The axial component of the force serves at least to cancel the weight of the feeler when the feeler is vertical. It also enables the feeler to be "pushed" towards the bottom of the bezel when the bezel is strongly "skewed" and one of the side surfaces of its V-shape is inclined too steeply to enable a transverse force on its own to cause the feeler to slide along the bottom of the bezel.

Advantageously, the axial component and the transverse component of the overall force then vary continuously or in steps so that their resultant varies in direction.

It is thus possible to cause the two components of the overall force to vary independently in such a manner that the overall force presents a value and a direction that are optimized as a function of the "skew" and of the camber of the frame.

According to another advantageous characteristic of the invention, for the eyeglass frame having an inside that is to be positioned facing the eyes of the wearer, the axial component of the overall force is directed towards the inside of the frame.

Advantageously, for the eyeglass frame having an inside that is to be positioned facing the eyes of the wearer, the value of the position of the feeler along the first axis increases with the feeler going towards the inside of the frame, the value of the axial component of the overall force growing continuously or in steps, while the value of the position of the feeler increases.

Thus, when the feeler detects that the frame has a large camber, and consequently that it has a large amount of "skew", the actuator means apply an overall force that presents a direction that is closer to that of the first axis. Thus, the axis along which the overall force is applied and the axis of symmetry of the V-shape formed by the bezel at the measurement point conserve directions that are nearly parallel, regardless of the point being felt on the frame and regardless of the camber of the frame.

According to another advantageous characteristic of the invention, for the feeler presenting an angular position about the axis of rotation, the overall force varies continuously or in steps as a function of the angular position of the feeler. Advantageously, one and/or the other of the axial and transverse components of the overall force then vary(ies) continuously or in steps as a function of the angular position of the feeler.

Thus, when the overall force in particular varies in steps as a function of the position of the feeler about the axis of rotation, it is possible to cause both the axial and the transverse components of the force to vary continuously as a function of the angular position of the feeler. This smoothing of the overall force then makes it possible to cause the overall force to vary in closer compliance with the "skew" of the frame.

Advantageously, for said axis of rotation not being vertical, the transverse component of the overall force varies continuously or in steps as a function of the angular position of the feeler.

Thus, when for reasons of comfort for the optician, the axis of rotation of the feeler is not designed to be vertical, it is necessary to take account of the weight asymmetry of the feeler when calculating the transverse component of the overall force to be applied to the frame. Regardless of the position of the frame, and thus of said axis of rotation, the force felt by the frame needs to be equivalent to the force it would feel if the axis of rotation of the feeler were vertical.

DETAILED DESCRIPTION OF AN EMBODIMENT

The following description with reference to the accompanying drawings that are given by way of non-limiting example makes it clear what the invention consists in and how it can be implemented.

In the accompanying drawings:

FIGS. 6A and 6B are section views of the bezel of a rim, at two points around its outline.

FIG. 1 is a general view of an outline reader appliance 1 as it appears to its user. This appliance includes a top cover 2 covering the entire appliance with the exception of a central top portion.

Figure 1:
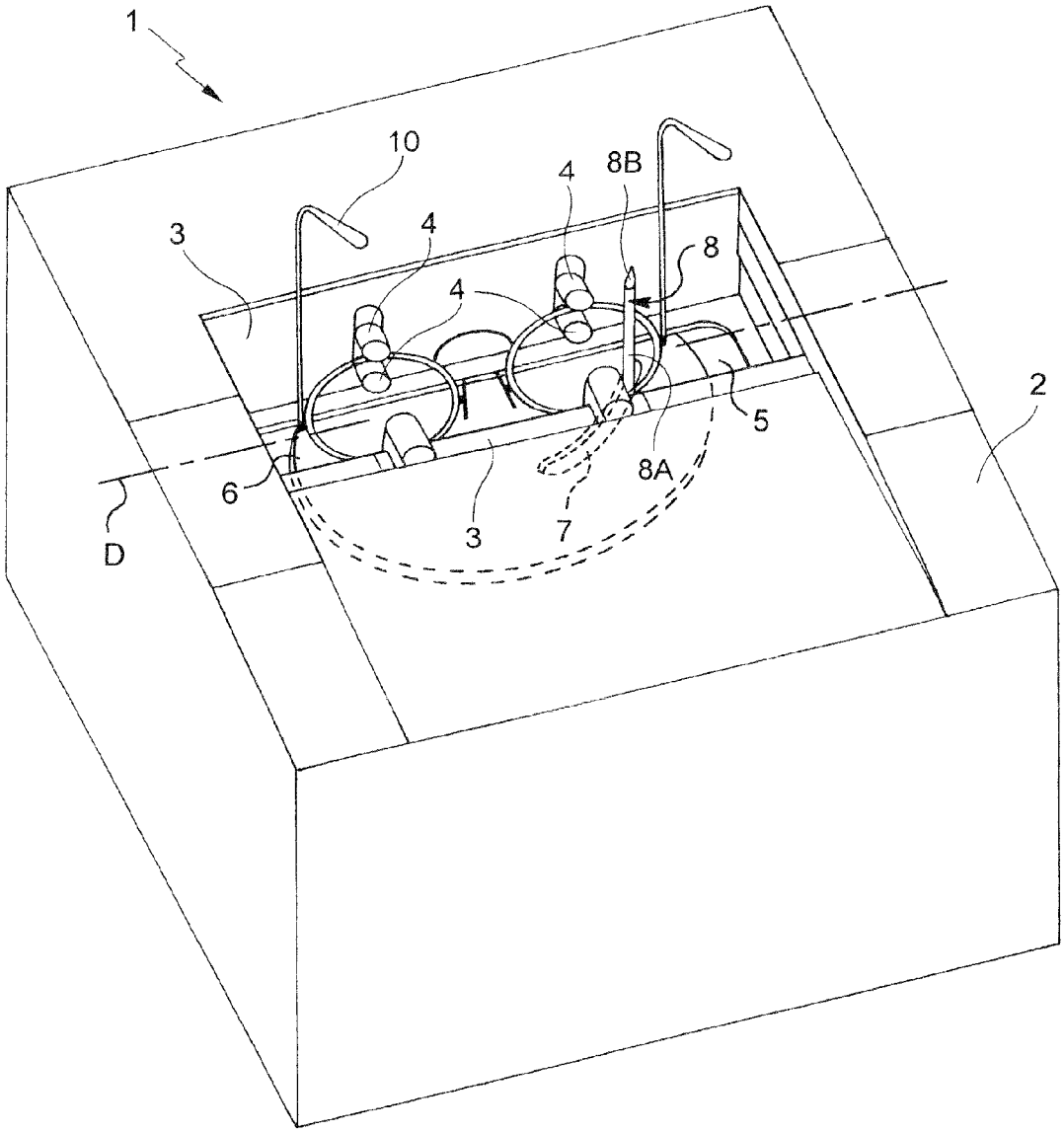
FIG. 1 is a perspective view of an outline reader appliance receiving an eyeglass frame from which the shapes of the rims are to be read by a feeler.

The outline reader appliance 1 also has a set of two jaws 3 in which at least one of the jaws 3 is movable relative to the other so that the jaws 3 can be moved together or apart relative to each other so as to form a clamp device. Each of the jaws 3 is also provided with two pincers, each made up of two movable studs suitable for clamping between them an eyeglass frame 10. The frame 10 can then be held stationary on the outline reader appliance 1.

In the space left visible by the central top opening in the cover 2, there can be seen a structure 5. A plate (not visible) can move in translation on the structure 5 along a transfer axis D. A turntable 6 is mounted to turn on the plate 6. The turntable 6 is thus suitable for taking up two positions on the transfer axis D: a first position in which the center of the turntable 6 is located between the two pairs of studs 4 holding the rim corresponding to the right eye of the frame 10; and a second position in which the center of the turntable 6 is located between the two pairs of studs 4 holding the rim corresponding to the left eye of the frame 10. The turntable 6 possesses an axis of rotation B defined as being the axis normal to the front face of the turntable 6 and passing through its center. The turntable 6 also includes an oblong slot 7 of circularly arcuate shape through which there projects a feeler 8 comprising a support rod 8A and, at its end, a feeler finger 8B for following the outline of the frame 10 being felt by making contact therewith.

The turntable 6 is guided in rotation about a first axis, its axis of rotation B, by three guide wheels (not shown) placed regularly around its periphery and held on the plate of the outline reader appliance 1. Alternatively, these wheels can be controlled by a motor-encoder (not shown) enabling the turntable 6 to be turned under control and enabling its angular position to be read at any time, with the angular position T of the feeler 8 depending therefrom.

In this example, it can be seen that the circularly arcuate slot 7 is of a length that corresponds approximately to the radius of the turntable 6 and that it extends between the center of the turntable 6 and its periphery. The circular arc described by the slot 7 is centered on a carrier axis A.

Figure 2:
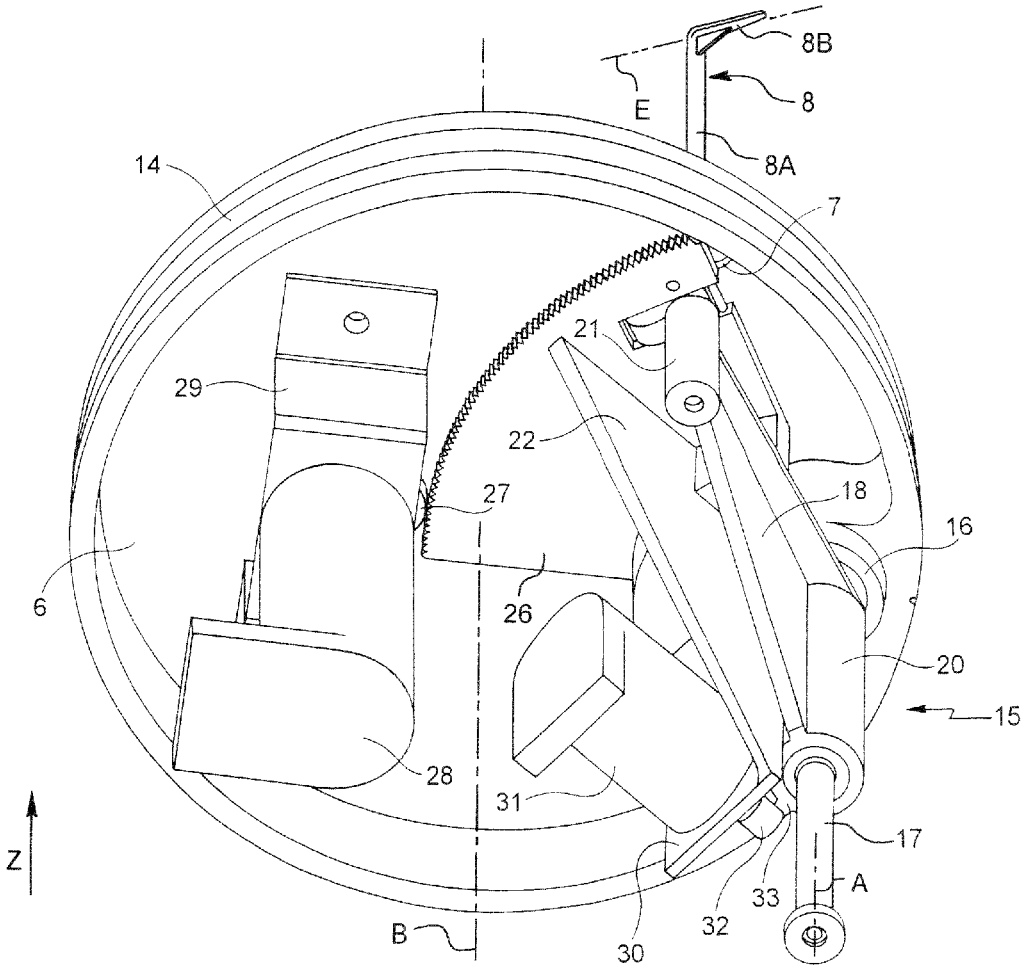
FIGS. 2 and 3 are perspective views of the underside of the turntable taken from the FIG. 1 appliance, these FIGS. 2 and 3 showing the reader subassembly carried by the turntable as viewed from two different angles.
Figure 3:
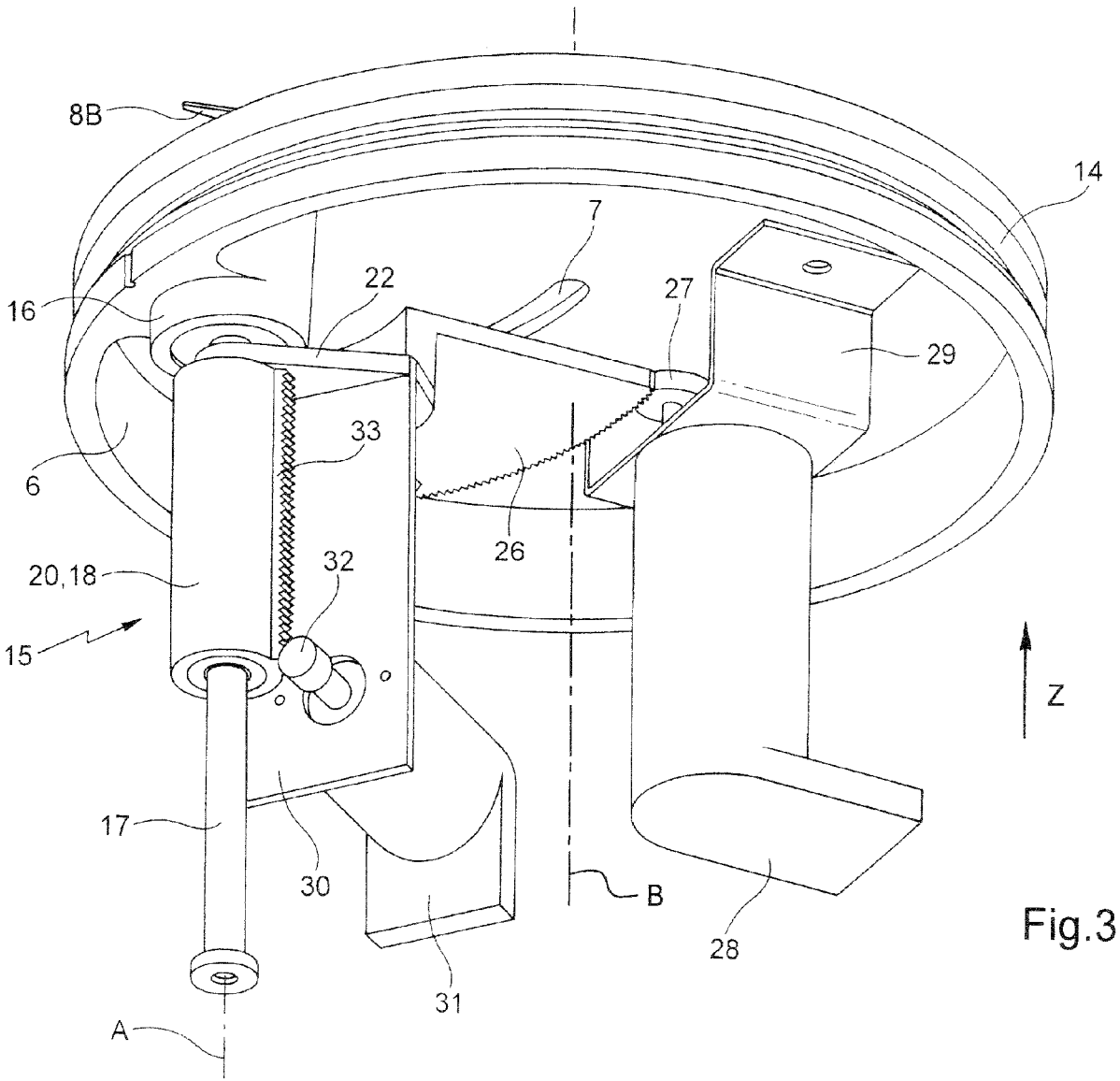

After the appliance 1 has been disassembled, the turntable 6 can be extracted from the structure 5. It then appears as shown in FIGS. 2 and 3. The perspective view of FIG. 2 shows a groove 14 disposed in the edge face of the turntable 6, all around its circumference. The groove 14 co-operates with the guide wheels of the plate. The turntable 6 carries a reader subassembly 15. FIGS. 2 and 3 show the reader subassembly 15 seen from two different viewing angles. The reader subassembly 15 includes a bearing 16 mounting a carrier shaft 17 mounted to rotate relative to the turntable 6. This carrier shaft 17 has the carrier axis A as its axis.

With reference to FIG. 2, a carrier arm 18 is mounted on the carrier shaft 17. At one of its ends, the carrier arm 18 carries a sleeve 20 enabling the carrier arm 18 to turn about the carrier axis 4 and also enabling it to move in translation along said axis. At its end remote from the sleeve 20, the carrier arm 18 has a cylindrical support 21 carrying the support rod 8A of the feeler 8 in such a manner as to ensure that the axis of the support rod 8A remains parallel to the carrier axis A.

This setup enables the feeler 8 to move following the circular arc of the slot 7, in a plane orthogonal to the axis of rotation B of the turntable 6, the axis of rotation B being parallel to the axis A in this example. Furthermore, the feeler 8 can perform retraction and extension movement relative to the front face of the turntable 6 when the carrier arm 18 slides along the axis A.

The reader subassembly 15 also has a guide arm 22 attached to the base of the shaft 17. The length of the guide arm 22 is sufficient to reach the slot 7. The guide arm 22 has a toothed semicircular portion 26 centered on the carrier axis A. The teeth of the semicircular portion 26 engage with an intermediate gearwheel 27, in turn meshing with the gearwheel (not shown) of a motor-encoder 28 mounted on a bracket 29 that is secured to the turntable 6. The teeth of the intermediate gearwheel 27 are not shown in order to keep the figures clear. The guide arm 22 has a vertical bracket 30 extending parallel to the carrier axis A, and having fastened thereon a motor-encoder 31 with a gearwheel 32 that meshes with a rack 33 extending along the sleeve 20 of the carrier arm 18. The rack 33 extends parallel to the carrier axis. The teeth of the gearwheel 32 are not shown for the same reasons of clarity as above.

The motor-encoder 28 is thus suitable for causing the feeler 8 to pivot about the carrier axis A. Consequently, it enables a transverse force Ft to be exerted on the feeler 8 along a force axis E. This force axis E is defined as being the axis passing through the axis of the support rod 8A and tangential to the circular arc described by the slot 7.

The motor-encoder 31 is suitable for moving the feeler in translation along an axis parallel to the carrier axis A. Consequently, it serves to exert a weight-compensation torque Cz inducing an axial force Fa on the feeler 8 along an axis parallel to the carrier axis A.

These axial and transverse forces Fa and Ft thus serve to deliver an overall force F on the feeler. The axial force Fa thus corresponds to the axial component of the overall force F and the transverse force Ft corresponds to the transverse component of the overall force F.

Figure 4:
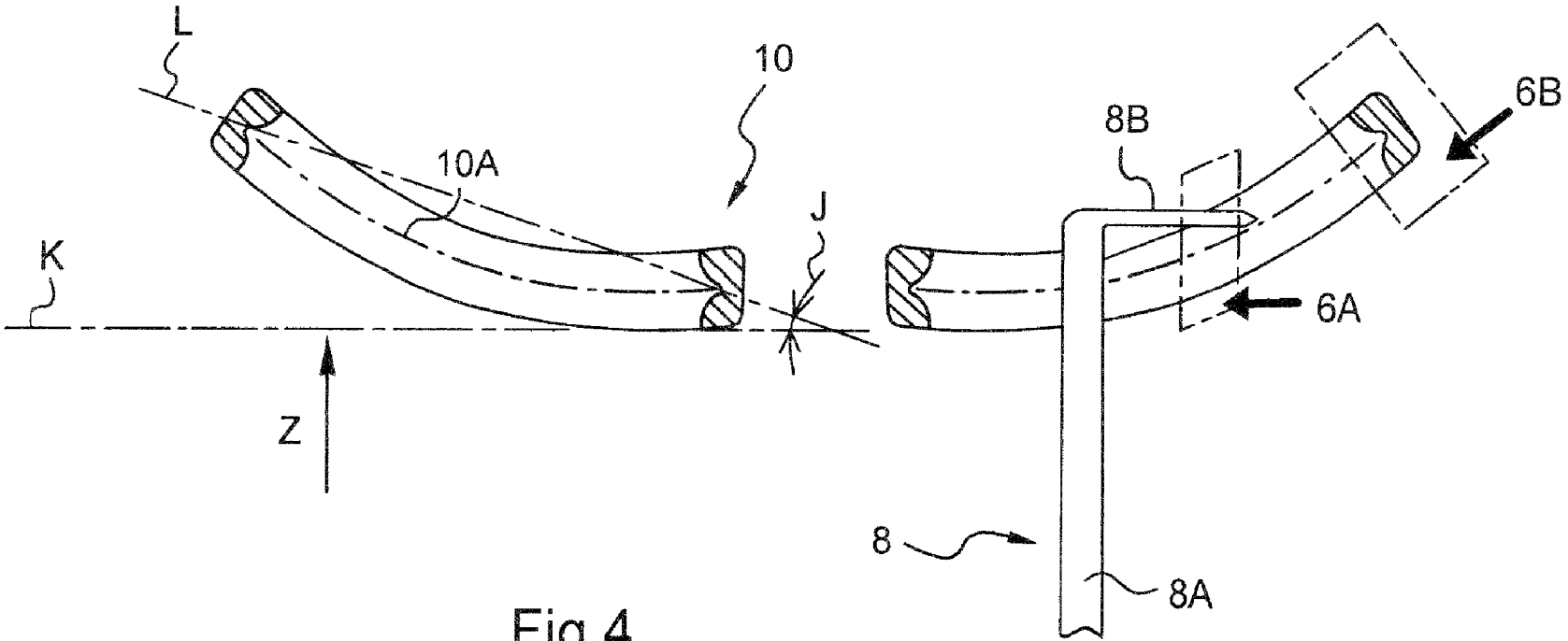
FIG. 4 is a section view of the rims of shape that is read by the feeler.

FIG. 4 shows the top end of the feeler 8 with the feeler finger 8B. The feeler finger 8B extends along an axis perpendicular to the axis of the support rod 8A. It presents a pointed tip for inserting in the bezel 10A of the frame 10 in order to read the shape of its outline.

When a frame 10 is placed in the outline reader appliance 1, each point of the frame 10 can be defined by three coordinates in three-dimensional space. The origin of the frame of reference corresponds to the center of the front face of the turntable 6, and it is possible to use a right cylindrical frame of reference in which the third axis corresponds to the axis of rotation B of the turntable 6 and defines an altitude Z of the point being felt. A point on the eyeglass frame is thus identified by its radius, its angular position T, and its altitude Z.

The outline reader appliance 1 also has an electronic and/or computer device serving firstly to control the motor-encoders 28, 31, and secondly to pick up and store the data transmitted thereto by the motor-encoders 28, 31.

In this example, particular attention is given to frames that are strongly curved, i.e. strongly cambered relative to the general plane of the rims of the frame 10. An example of such a frame is shown in FIG. 4.

The curvature (or camber) of a frame can be measured in terms of a curvature angle J. This curvature angle J corresponds to the angle formed between the general plane K of the rims of the frame 10 (a vertical plane containing the nose bridge interconnecting the rims of the frame) and the axis L defined as being the axis passing through two distinct points of the bezel 10A (typically one is located close to the nose portion of the rim and the other close to the temple portion of the rim) and presenting the greatest angle of inclination relative to the general plane K of the rims of the frame 10.

The term "strongly curved" is used herein to mean a frame in which the curvature angle J is greater than 20 degrees.

Frames 10 of this strongly curved type generally also present twisting of the bezel 10A referred to herein as "skew".

Figure 5:
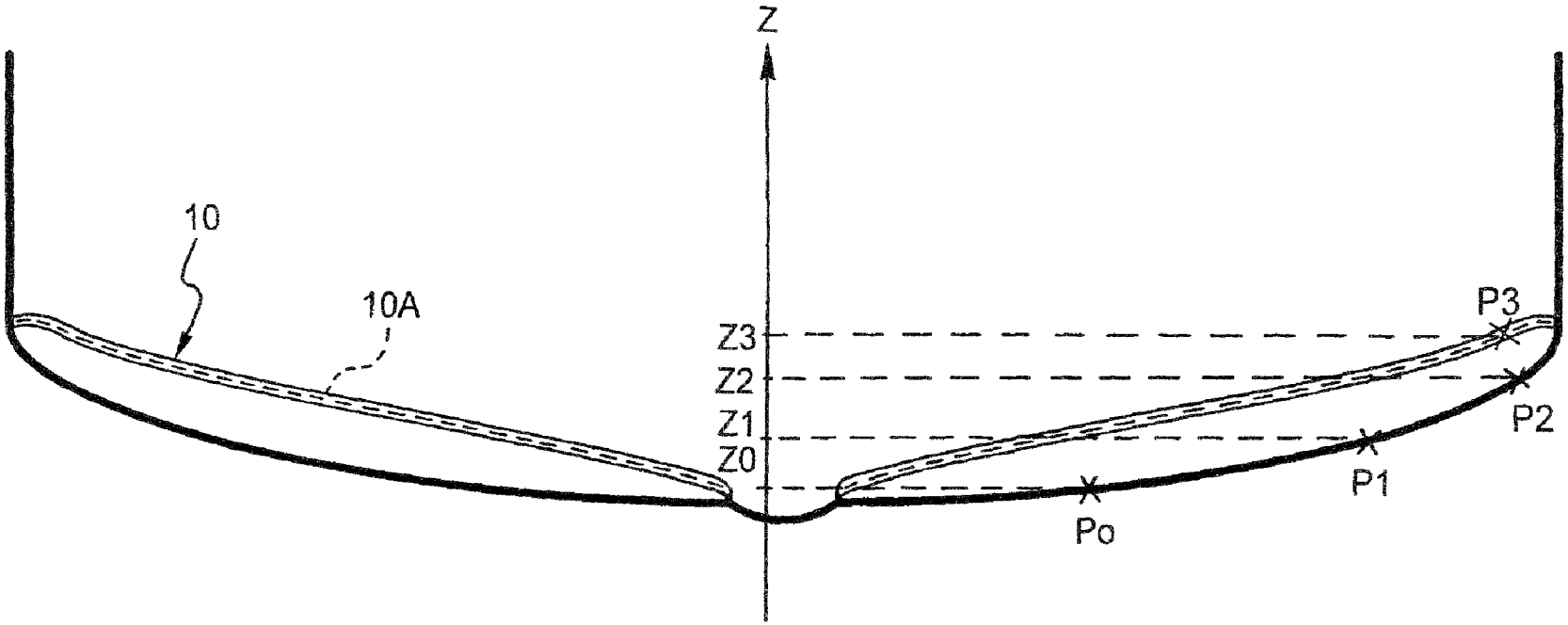
FIG. 5 is a plan view of the eyeglass frame showing the camber of each of the rims.

As can be seen in FIG. 5, four distinct zones can be distinguished on each rim of a frame 10.

Firstly there is a first zone situated close to the nose of the wearer, between P0 and P1. This first zone is cambered little and "skewed" little.

There can also be seen a second zone situated on the bottom portion of the frame, between P1 and P2. Along this zone, the camber and the "skew" of the frame 10 increase quickly. Still in this zone, and as can be seen in FIG. 6A, the "skew" of the bezel is said to be favorable. Thus, the profile of the bezel is such that if a large force is applied by the feeler finger 8B against the bezel in the direction U, corresponding to the force axis E in the outline reader appliance 1, then the feeler finger 8B is positioned in the bottom of the bezel.

There is a third zone between P2 and P3. Along this zone, the camber and the "skew" of the frame reach their maximum values. In this zone, as shown in FIG. 6B, the "skew" of the bezel is said to be unfavorable. The profile of the bezel is such that if a large force is applied by the feeler finger 8B against the bezel 10A along the direction U, corresponding to the force axis E of the outline reader appliance 1, then the feeler finger 8B escapes from the bezel.

Finally, there is a fourth zone from P3 and P0. Along this zone, the "skew" and the camber of the bezel 10A decrease. In addition, in this fourth zone, the "skew" is favorable.

It should be observed that each of these points P0, P1, P2, and P3 possesses a position along an axis Z that is referenced respectively Z0, Z1, Z2, and Z3. These positions of points along the axis Z are referred herein as "altitudes". It should also be observed that when the frame 10 is installed in the outline reader appliance 1, the axis Z is parallel to the axis of rotation B.

Prior to starting feeling, the eyeglass frame 10 is inserted between the studs 4 of the jaws 3 so that each of the rims of the frame 10 is ready to be felt along a path starting by inserting the feeler between two studs 4 corresponding to the bottom portion of the frame 10, and then following the bezel 10A of the frame 10 so as to cover the entire circumference of the rim of the frame 10. After this insertion, the electronic and/or computer device calibrates the weight-compensation torque Cz so that the feeler 8 is in equilibrium, regardless of its altitude Z.

In operation, the feeler 8 is initially inserted in the rim corresponding to the wearer's right eye. To do this, the plate on which the turntable 6 is mounted is moved using a motor and a rack connection (not shown) such that the center of the turntable 6 is disposed between the two pairs of studs 4 of the two jaws 3 holding the rim of the frame that corresponds to the wearer's right eye.

The feeler finger 8B then automatically takes up an altitude Z0. This altitude Z0 is known and corresponds to the altitude of the point situated halfway between the two studs 4 holding the frame 10. In order to place the feeler finger 8B at this altitude Z0, the reader subassembly 15 has an on-board mechanism enabling the feeler 8 to move parallel to the axis A. This mechanism comprises the motor-encoder 31 that is adapted to position the sleeve 20, and consequently the carrier arm 18, at the desired height along the shaft 17. The feeler 8 can thus move along the Z axis.

The feeler finger 8B then moves in the plane in which the frame 10 is held, towards the point P0 corresponding to the point situated between the two studs 4 holding the frame 10 on its low portion. To do this, combined rotary movement about the axis A is allowed to the guide arm 22 and to the carrier arm 18, thereby enabling the guide arm 22 under drive from the motor 28 in turn to drive the feeler 8 in rotation about the axis A, along the slot 7.

In this initial position, when the feeler finger 8B is disposed at the point P0, the turntable 6 defines an angular position T of zero. The guide wheels of the turntable 6 are then capable of causing the reader subassembly 15 to turn relative to the stationary structure 5, the reader subassembly 15 being carried on the turntable 6. The motor-encoder (not shown) that drives the wheels inserted in the groove 14 serves not only to turn the turntable 6, but also to inform the electronic and/or computer device about the value of the angular position T presented by the feeler 8 relative to its initial position.

When the turntable 6 begins to turn, the value of the angular position T of the feeler 8 increases. The feeler 8 moves along the bottom of the bezel and is guided in radius and in altitude Z by the bezel 10A. When the feeler is inserted in the rim of the frame 10 that corresponds to the wearer's right eye, the feeler 8 moves in the counterclockwise direction.

Contact between the feeler finger 8B and the bezel 10A is ensured by the motor-encoders 28 and 31. These motor-encoders exert an overall force on the feeler 8 that enables the feeler finger 8B to remain in contact with the bottom of the bezel 10A. The minimum overall force exerted corresponds to a transverse force Ft enabling the feeler to be held against the bezel 11A and to an axial force Fa serving to counter the weight of the feeler 8 and of the carrier arm 18.

While the turntable 6 is turning, the motor-encoder 31 is thus active, however it also acts as an encoder for reading the successive positions of the carrier arm 18 along the axis A. These positions enable the electronic and/or computer device to know at all times the radial and angular coordinates of the feeler finger 8B relative to the turntable 6. Knowing the coordinates of the center of the turntable 6 relative to the structure 5, the electronic and/or computer device can thus determine the radial and angular coordinates of the feeler finger 8B in a stationary frame of reference tied to the structure 5.

In the same manner, the motor-encoder 31 also exerts a weight-compensation force Cz serving at least to cancel artificially the weight of the assembly constituted by the carrier arm 18 and the feeler 8. This weight-compensation torque Cz can take on a value that is greater so as to enable the feeler finger 8B to follow more easily the outline for feeling when the frame 10 is strongly cambered. The motor-encoder 31 also acts simultaneously as an encoder, thereby enabling the electronic and/or computer device to know the altitude Z of the feeler finger 8B of the feeler 8.

Thus, the motor-encoders together enable the electronic and/or computer device to determine the three-dimensional coordinates of the point being felt by the feeler 8, and consequently the three-dimensional coordinates of a set of points characterizing the outline of the bottom of the bezel once the feeler 8 has felt the bottom of the bezel 10A accurately.

In order to acquire this accuracy in following the bottom of the bezel, it is necessary for the motor-encoders 28, 31 to exert torques that help the feeler finger 8B to remain in the bottom of the bezel 10A.

To do this, so long as the motor-encoder 31 measures an altitude of the bezel lying in the range Z0 to Z1, the motor-encoder 31 applies a weight-compensation torque Cz0 and the motor-encoder 28 applies a torque that generates a transverse force Ft0 on the feeler 8. The weight-compensation torque Cz0 gives rise to an axial force Fa serving to counter the weight of the feeler 8 and of the carrier arm 18. The transverse force Ft0 gives rise to the feeler 8 pressing against the bezel 10A along the force axis E with a force that enables the feeler to follow the bottom of the bezel providing the bezel is "skewed" to a small extent only.

The electronic and/or computer device is programmed so that with increasing value for the angular position T of the feeler 8, if the motor-encoder 31 measures an altitude for the feeler finger 8B that is greater than Z1 (corresponding to point P1), then the motor-encoder 31 applies a weight-compensation torque of value Cz1 that is greater than the value Cz0 so that the motor-encoder 28 applies a torque giving rise to a transverse force of value Ft1 that is greater than that of the transverse force Ft0. Between P1 and P2, the "skew" of the bezel is considerable. The overall force applied by the feeler finger 8B on the bezel 10A therefore needs to present a greater value in order to overcome friction between the feeler 8 and the bezel 10A that would otherwise prevent the feeler finger 8B from reaching the bottom of the bezel 10A in the frame 10.

With the angular position T continuing to increase, if the motor-encoder 31 measures an altitude for the bezel that is less than Z1, then the weight-compensation torque returns to the value Cz0 and the transverse force returns to its value Ft0.

In contrast, if the motor-encoder 31 measures an altitude for the bezel that is greater than Z2 (corresponding to point P2), then the motor-encoder 31 applies a weight-compensation torque Cz2 that is greater than the weight-compensation torque Cz1, and the motor-encoder 28 applies a torque that leads to a transverse force Ft2 that is less than the transverse force Ft1. Since the "skew" of the bezel 10A is unfavorable, the overall force must not present a direction orthogonal to the axis of rotation B of the feeler 8, since that would allow the feeler to escape from the bezel 10A. The axial force Fa created by the weight-compensation torque Cz is thus increased so that the overall force presents a direction that enables the feeler 8 to remain in the bottom of the bezel 10A.

Following this step, if the motor-encoder 31 measures an altitude for the bezel that is lower than Z2, then the weight-compensation torque returns to the value Cz1 and the transverse force returns to the value Ft1, and then on measuring an altitude less than Z1, the weight-compensation torque returns to the value Cz0 and the transverse force returns to its value Ft0.

In contrast, if it measures an altitude Z3 (corresponding to point P3), then the weight-compensation torque returns directly to its initial value Cz0 and the transverse force returns to its initial value Ft0.

Examples of values that are applicable to the method of feeling the bezel 10A of a rim corresponding to the wearer's right eye are summarized in the following table of values:

| | | | |
|---|---|---|---|
| Z: | Z0 = 12 mm | Z1 = 16 mm | Z2 = 28 mm |
| Cz: | Cz0 = 6 mN · m | Cz1 = 9 mN · m | Cz2 = 10 mN · m |
| Ft: | Ft0 = 60 g | Ft1 = 65 g | Ft2 = 45 g |

Where values for Z are given in millimeters (mm), for Cz in millinewton-meters (mN.m), and for Ft in grams weight (g).

In a variant, it should be observed that it is possible to program the electronic and/or computer device in such a manner that in each altitude range, e.g. between P2 and P3, the overall force is not constant but rather a function of the angular position T of the feeler 8. To do this, it is necessary to program the electronic and/or computer device so that it can vary the torques delivered by the motor-encoders 28, 31 in known manner.

When the value for the angular position T of the feeler 8 reaches 360 degrees, then the guide wheels for the turntable 6 are stopped. The bezel 10A of the rim corresponding to the wearer's right eye then presents an outline of shape that is known.

In order to feel the second rim of the frame, the feeler 8 moves down along the axis Z to under the frame 10. The plate then moves transversely along the transfer axis D so as to reach its second position in which the center of the turntable 6 is positioned between the studs 4 of the two jaws 3 holding the rim corresponding to the wearer's left eye.

The feeler 8 is then placed automatically at the height Z0 inside the second rim to be measured of the frame 10, against the bezel of the second rim, between the two studs 4 holding the bottom portion of this rim of the frame 10.

The bezel is then felt in the same manner as described above, but turning clockwise.

The present invention is not limited in any way to the embodiment described and shown, and the person skilled in the art can provide any variant complying with its spirit.

For example, in a variant embodiment in which the plate, and consequently the feeler 8, is inclined, the feeling force is determined differently.

Thus, it is necessary to take account of the weight of the feeler 8 and of the carrier arm 18 when calculating the force to be delivered to the feeler 8. The transverse force needs to be calculated as a function of the angular position T of the feeler 8 in real time. The transverse force is thus programmed to vary in application of the following formula:

$$Ft=Ft_i-K\cdot\cos(T)$$

where K is a positive constant depending on the degree of inclination of the plate, and $Ft_i$ corresponds to the values of the transverse force Ft in each zone of the frame 10. For example, K may have the value 15 grams when the plate is inclined at 45 degrees.

It is also appropriate to take this angle of inclination of the plate into account when calculating the values for the weight-compensation torque Cz in each of the zones of the frame 10.

In another variant embodiment, the values of the weight-compensation torque Cz and of the transverse force Ft may vary not as a function of the measured altitude, but as a function of the angular position of the feeler 8.

Thus, using the same method as that described above, the optician secures the frame 10 in the outline reader appliance 1. The electronic and/or computer device is informed whether the frame 10 is or is not strongly cambered. If not, then the appliance 1 reads each of the rims that are to be read with a weight-compensation torque Cz and a transverse force Ft that are constant. Otherwise, if the rim is strongly cambered, then their values do not remain constant. The electronic and/or computer device is then programmed so that:

when T lies in the range 0 degrees to 45 degrees, the motor-encoders 28, 31 apply a weight-compensation torque Cz of 6 mN.m and a transverse force Ft of 60 g;

when T lies in the range 45 degrees to 80 degrees, the motor-encoders 28, 31 apply a weight-compensation torque Cz of 9 mN.m and a transverse force Ft of 65 g;

when T lies in the range 80 degrees to 100 degrees, the motor-encoders 28, 31 apply a weight-compensation torque Cz of 10 mN.m and a transverse force Ft of 65 g;

when T lies in the range 100 degrees to 120 degrees, the motor-encoders 28, 31 apply a weight-compensation torque Cz of 9 mN.m and a transverse force Ft of 65 g; and when T lies in the range 120 degrees to 360 degrees, the motor-encoders 28, 31 apply a weight-compensation torque Cz of 6 mN.m and a transverse force Ft of 60 g.

Each of these ranges corresponds to a zone of the frame 10 that is cambered and "skewed" to a greater or lesser extent, with the feeler finger 8B remaining in the bottom of the bezel 10A, thus making it possible to read the bezels of the frame 10 accurately.

What is claimed is:

1. A method of reading the outline of the bezel of a rim of an eyeglass frame, the method comprising the steps of putting a feeler into contact against the bezel and of feeling the bezel by sliding or running said feeler along the bezel, the feeler being actuated by actuator means along at least a first axis normal to the general plane of the rims of the frame, wherein during reading, the overall force delivered by the actuator means is caused to vary, either continuously or in steps, as a function of the position of the feeler along the first axis and wherein the overall force delivered by the actuator means comprises an axial component parallel to the first axis and a transverse component orthogonal to the first axis, one and/or the other of said components varying as a function of the position of the feeler along the first axis, in such a manner that that the axial component of the overall force is directed towards an inside of the frame that is to be positioned facing the eyes of the wearer.

2. An outline reading method according to claim 1, in which the actuator means present an axis of rotation about which the feeler turns to enable it to slide along the complete outline of the rim, said axis of rotation of the feeler coinciding with the first axis.

3. An outline reading method according to claim 1, in which both the axial component and the transverse component of the overall force vary continuously or in steps so that their resultant varies in direction.

4. An outline reading method according to claim 1, in which the value of the position of the feeler along the first axis increases with the feeler going towards the inside of the frame, the value of the axial component of the overall force growing continuously or in steps while the value of the position of the feeler increases.

5. An outline reading method according to claim 1, in which, for the feeler presenting an angular position about the axis of rotation, the overall force varies continuously or in steps as a function of the angular position of the feeler.

6. An outline reading method according to claim 5, in which one and/or the other of the axial and transverse components of the overall force vary(ies) continuously or in steps as a function of the angular position of the feeler.

7. An outline reading method according to claim 5, in which, for said axis of rotation not being vertical, the transverse component of the overall force varies continuously or in steps as a function of the angular position of the feeler.

* * * * *